United States Patent [19]

Teetz et al.

[11] 4,412,497

[45] Nov. 1, 1983

[54] APPARATUS FOR DRIVING THREAD LEVERS ON EMBROIDERY MACHINES

[75] Inventors: Wolfgang Teetz, Kerken; Heinz-Georg Slomma, Viersen; Hans-Gerd Ripkens, Goch, all of Fed. Rep. of Germany

[73] Assignee: Maschinenfabrik Carl Zangs Aktiengesellschaft, Krefeld, Fed. Rep. of Germany

[21] Appl. No.: 230,198

[22] Filed: Feb. 2, 1981

[30] Foreign Application Priority Data

Feb. 28, 1980 [DE] Fed. Rep. of Germany ..... 3007473

[51] Int. Cl.[3] ..... D05C 11/16

[52] U.S. Cl. ..... 112/96

[58] Field of Search ..... 112/96, 241, 248, 249, 112/97

[56] References Cited

U.S. PATENT DOCUMENTS

| | | | |
|---|---|---|---|
| 377,409 | 2/1888 | Smith | 112/96 X |
| 3,307,509 | 3/1967 | Ioannilli et al. | 112/96 X |
| 4,295,433 | 10/1981 | Desprez et al. | 112/241 |

FOREIGN PATENT DOCUMENTS 2418799 3/1978 Fed. Rep. of Germany .

*Primary Examiner*—Werner H. Schroeder

*Assistant Examiner*—Andrew M. Falik

*Attorney, Agent, or Firm*—Martin A. Farber

[57] ABSTRACT

A device for driving at least one of a plurality of thread levers on multi-needle embroidery machines in which the thread levers of the needles which are disconnected at the time can be uncoupled from a oscillating drive shaft by displaceable coupling elements. In order to obtain an enclosed accident-proof development of the coupling elements at the same time with high reliability in operation and only slight wear, the thread levers are arranged on coupling sleeves, which sleeves surround the drive shaft, are mounted in common in a housing and are displaceable with the housing in the longitudinal direction of the drive shaft. Furthermore, at least one coupling sleeve can be coupled to the drive shaft by means of a coupling piece fastened to the drive shaft, while the other coupling sleeves (4) are held fast in non-turnable manner together with the housing by holding bars which extend into a groove of the sleeves, the bars being fixed in position and extending parallel to the drive shaft. The outer contour of the coupling piece and the opening in the coupling sleeves which surrounds the drive shaft can have a polygonal cross section with a plurality of drive surfaces, preferably in the manner of a spline shaft. The holding bars engage in part into the groove of the coupling sleeves and in part into a groove of the housing.

7 Claims, 2 Drawing Figures

Figures 1, 2:
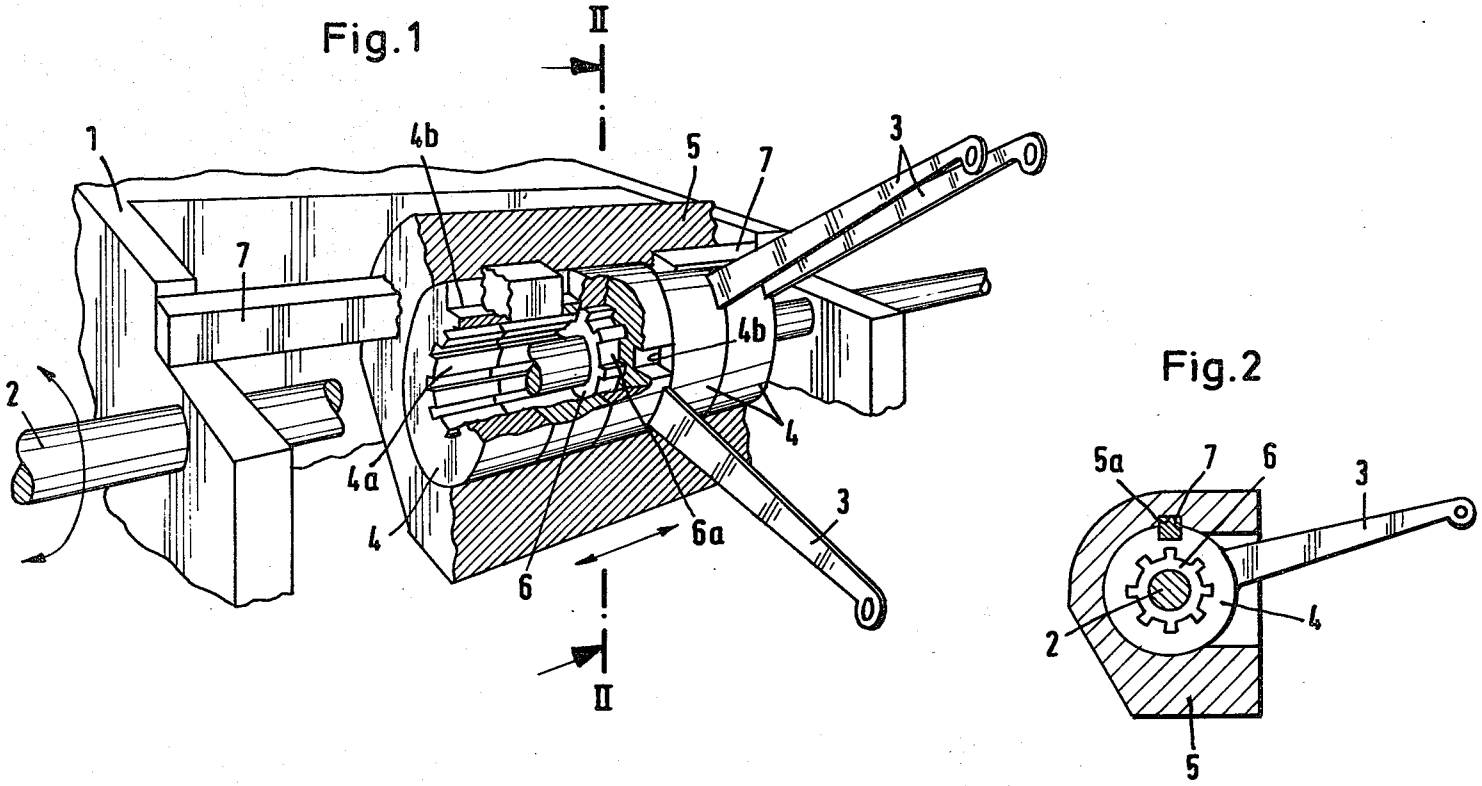

1
2
3
4
4a
4b
5
5a
6
6a
7
I
II

APPARATUS FOR DRIVING THREAD LEVERS ON EMBROIDERY MACHINES

The present invention relates to an apparatus for driving at least one of several thread levers on multi-needle embroidery machines in which the thread levers of the needles which are disconnected at the time can be uncoupled from the oscillating drive shaft by displaceable coupling elements.

In multi-needle embroidery machines the thread levers of the needles which are not embroidering must be disconnected in order, on the one hand, to decrease the stress on the threads which are not being embroidered and on the other hand to prevent the threads from entangling with each other.

For uncoupling the thread levers of the needles not participating at the time in the embroidering the aforementioned devices use coupling elements in the form of racks, toothed segments, gearwheels or claws which are rotated or translated in order to effect the coupling process. In these known embodiments the coupling elements are subjected to very high, and in part impact-like, loads and, in addition to this, are freely accessible so that they are particularly subject to trouble.

The object of the present invention is to avoid these disadvantages of the known prior art and further to develop a device of the aforementioned type in such a manner as to result in an enclosed, accident-proof development which has a high degree of reliability in operation and is subject to only slight wear.

The solution of this problem which is provided by the invention is aided by arranging the thread leavers on coupling sleeves which surround the main shaft, which sleeves are mounted in common in a housing and are displaceable with the housing in the longitudinal direction of the drive shaft, and that at least one coupling sleeve can be coupled to the drive shaft by means of a coupling piece fastened to the drive shaft, while the other coupling sleeves are held fast in nonrotatable manner together with the housing by holding bars which engage into a groove, the rails being mounted fixed in position and extending parallel to the drive shaft.

By the arrangement of the coupling sleeves within a housing the embodiment of the invention provides an enclosed, accident-proof construction which, in addition, has the advantage that it cannot be damaged or destroyed by foreign objects. The coupling sleeves which surround the drive shaft can be coupled via large drive surfaces with the coupling piece fastened to the drive shaft so as to obtain little wear and long life also on the part of these elements. The thread levers which are not participating at the time in the embroidery process are held securely fast by the holding rails, together with the housing, which results in an additional large-area support for the thread lever being driven at the time since said lever is arranged on the coupling sleeve.

In accordance with another feature of the invention, the outer contour of the coupling piece and the opening in the coupling sleeves which surrounds the drive shaft have a polygonal cross section with a plurality of driving surfaces so that a form-locked coupling (coupling held by the interlocking shape of the parts themselves) is effected over large surfaces. In a preferred embodiment, the contours are formed as a cross-section of a spline shaft. Since the displacement of the housing with the coupling sleeves relative to the drive shaft, the latter being mounted for rotation, but in an axially non-displaceable manner, takes place when the embroidery machine is stopped, the formation of the cross section in the form of a spline shaft provides a construction which is particularly insensitive to impact and is suitable, particularly, for a higher number of changes in motion per minute.

In order to create a particularly simple construction for the non-rotatable mounting of both of the coupling halves and of the housing, it is furthermore proposed by the invention that the holding bars be caused to engage in part into the groove of the coupling sleeves and in part into a groove of the housing. In this way special measures for mounting the displaceable housing in non-rotatable manner are made unnecessary.

One particularly suitable embodiment of the invention is obtained if the distance between the ends of the two holding bars is slightly greater and the axial length of the coupling piece slightly less than the axial width of the coupling sleeve or sleeves to be coupled. In this way less stringent demands are made on the accuracy of the axial displacement of the housing with the coupling sleeves. This displacement can be effected by a drive motor designed as a positioner drive.

One embodiment of the device in accordance with the invention is shown in the drawing in which:

FIG. 1 is a perspective view partially in section of the device, and

FIG. 2 is a cross section along the section line II—II in FIG. 1. In FIG. 1 there can be noted the part of a support 1 which is arranged above the needle bars (not shown) of an embroidery machine and on which a drive shaft 2 is mounted in turnable but axially non-displaceable fashion. This drive shaft 2 carries out an oscillating drive movement, i.e. a drive movement which goes back and forth through a given angle of rotation, this movement being necessary in order to drive one of a total of five thread levers 3. In the embodiment shown in FIGS. 1 and 2, the angle of rotation of the drive shaft 2 is about 30°.

Each thread lever 3, has a needle bar associated with it and is arranged on a coupling sleeve 4 which has essentially the shape of a circular ring. The cylindrical outer surface of these coupling sleeves 4 is supported for rotation in a cylindrical bore in the housing 5.

The opening 4*a* of the coupling sleeves 4 which surrounds the drive shaft 2 is developed in the embodiment shown with a cross section which corresponds to the cross section of a spline shaft. The outer contour 6 *a* of a coupling piece 6, which is fixed fast for rotation on the drive shaft 2, has the same cross section.

The axial length of the coupling piece 6 is slightly less than the axial width of one coupling sleeve 4 so that when the coupling piece 6 is within a coupling sleeve 4 only this one coupling sleeve 4 is coupled to the drive shaft 2. The selection of the specific coupling sleeve 4 to be driven and thus of the corresponding thread lever 3 is effected by a shifting of the housing 5 together with all coupling sleeves 4 relative to the drive shaft 2 and the coupling piece 6 which is fastened to it.

In order to hold those coupling sleeves which are not coupled at the time with the drive shaft 2 fast in the upper position, two holding bars or rails 7 are arranged on a support 1, approximately the lower half of said holding bars engaging into a groove 4*b* of the coupling sleeves 4, as can best be noted from FIG. 2. Their upper half extends within a groove 5*a* in the housing 5 so that the housing 5 is simultaneously guided and secured against rotation by the holding bars 7.

The distance between the ends of the two holding bars 7 is slightly greater than the axial width of one coupling sleeve 4 so that—as shown in the drawing—in each case one coupling sleeve 4 with its thread lever 3 can be driven from the drive shaft 2 via the coupling piece 6.

It can be seen from the drawing that the embodiment described above not only provides a dependable, large-area support of the coupling sleeves 4 within the housing 5 but also an encapsulated, and thus protected, construction for the coupling elements, all of which are disposed within the housing 5 and cooperate with large engagement surfaces so as to assure a dependable transmission of power, with long life and dependable operation.

We claim:

1. In a device for driving at least one of a plurality of thread levers on multi-needle embroidery machines in which the thread levers of the needles disconnected at the time can be uncoupled by displaceable coupling elements from an oscillating drive shaft, the improvement wherein said coupling elements comprise coupling sleeves, a housing, said coupling sleeves are formed with grooves, respectively, and are mounted jointly in said housing, the thread levers are arranged on said coupling sleeves, respectively, said coupling sleeves surround the drive shaft and are mounted displaceable with said housing in the longitudinal direction of the drive shaft, holding rails mounted fixed in position extend parallel to the drive shaft and are adapted to engage in said grooves of said coupling sleeves, a coupling piece means is fastened to the drive shaft, at least one of the coupling sleeves respectively can be coupled to the drive shaft by said coupling piece means, while the other of said coupling sleeves are held fast, in non-rotatable manner, together with said housing by said holding rails which engage into said grooves of said other coupling sleeves.

2. The device according to claim 1, wherein said coupling sleeves are each formed with an opening, the outer contour of said coupling piece means and said openings formed in said coupling sleeves have a polygonal cross section with a plurality of cooperative drive surfaces.

3. The device according to claim 2, wherein said contours are formed as cross sections of a spline shaft.

4. The device according to claim 1, wherein said housing is formed with a groove, said holding rails engage in part into said grooves of said others of said coupling sleeves and in part into said groove formed in said housing.

5. The device according to claim 1 or 4, wherein said holding rails constitute two holding rails having facing ends spaced apart from each other by a distance which is slightly greater than, and the axial length of said coupling piece means is slightly less than, the axial width of the at least one of the coupling sleeves to be coupled.

6. The device according to claim 4, wherein said grooves of said others of said coupling sleeves respectively and said housing are aligned with said holding rails.

7. The device according to claim 1, wherein said drive shaft and said coupling piece means are jointly rotatable but longitudinally fixed in position, said coupling sleeves are rotatable relative to said housing and to each other.

* * * * *